US006101654A

United States Patent [19]

Cachot

[11] Patent Number: 6,101,654

[45] Date of Patent: Aug. 15, 2000

[54] MULTIFUNCTIONAL POCKET TOOL INCLUDING PLIERS

[75] Inventor: Maurice Cachot, Delémont, Switzerland

[73] Assignee: Wenger S.A., Delemont, Switzerland

[21] Appl. No.: 09/298,864

[22] Filed: Apr. 26, 1999

[30] Foreign Application Priority Data

May 18, 1998 [EP] European Pat. Off. ..... 98810453

[51] Int. Cl.[7] ..... B25B 7/22

[52] U.S. Cl. ..... 7/128

[58] Field of Search ..... 7/128; 81/300, 81/318–320, 324, 416, 421, 427.5, 486

[56] References Cited

U.S. PATENT DOCUMENTS

| | | | |
|---|---|---|---|
| 1,330,657 | 2/1920 | Skinner . | |
| 1,889,556 | 11/1932 | Lane . | |
| 4,122,569 | 10/1978 | Hitchcock . | |
| 4,512,051 | 4/1985 | Magan . | |
| 5,033,338 | 7/1991 | Ford, Jr. | 81/318 |
| 5,245,721 | 9/1993 | Lowe et al. . | |
| 5,802,936 | 9/1998 | Liu | 81/450 |
| 5,809,600 | 9/1998 | Cachot . | |

FOREIGN PATENT DOCUMENTS

| | | |
|---|---|---|
| 0 776 737 A1 | 6/1997 | European Pat. Off. . |
| 1.131.872 | 2/1957 | France . |
| 91 03 496 U | 8/1991 | Germany . |
| 227932 | 10/1923 | United Kingdom . |
| 698921 | 10/1953 | United Kingdom . |

*Primary Examiner*—James G. Smith
*Assistant Examiner*—David B Thomas

[57] ABSTRACT

A multifunctional pliers-knife (1) has two lateral sidepieces (10, 11) serving as a handle for the tool, a plurality of tools disposed between the sidepieces, and a pair of pliers having a first jaw (18) fixed integrally to the lateral sidepieces and a second jaw (14) capable of pivoting relative to the first jaw about a transverse spindle (40) at the front end of the tool. Means for locking the pliers in closed position include at least one locking element (4) disposed near this front end and capable of being moved in a plane parallel to the sidepieces between a position locking the pliers in closed position and a position permitting the pliers to be opened. The locking element has the advantage of being easily manipulated with the thumb of the hand holding the pliers-knife and is of sturdy construction.

12 Claims, 3 Drawing Sheets

MULTIFUNCTIONAL POCKET TOOL INCLUDING PLIERS

This invention relates to pocket tools, and more particularly to a multifunctional pocket tool of the type having two lateral sidepieces serving as a handle for the tool, a plurality of tools disposed between the sidepieces, pliers having a first jaw fixed integrally to the lateral sidepieces and a second jaw capable of pivoting relative to the first jaw about a transverse spindle at the front end of the tool, as well as means for locking the pliers in closed position.

In the present specification, a multifunctional pocket tool is understood to mean, for example, a multifunction pocket knife such as the so-called "Swiss army knife," a polyvalent penknife, or a closing knife. However, the application also applies to sliding-blade knives such as switchblade knives, or to multifunction pocket tools without any knife. The invention applies particularly to polyvalent pliers-knives and to multifunction pocket pliers.

U.S. Pat. No. 5,809,600 assigned to the present assignee, the entire contents of which are incorporated herein by reference, describes a pliers-knife comprising two lateral sidepieces and a plurality of utensils capable of sliding or pivoting between the two sidepieces, one of the utensils consisting of a pair of universal pliers. One of the jaws of the pliers is fixed, while the other can be actuated by a pliers handle pivoting about a spindle joining the two sidepieces. However, no element in the pliers-knife described allows the two jaws to be held in closed position, so that these pliers may unexpectedly open and then be difficult to pull out of the user's pocket, for example.

FIG. 1 of the accompanying drawings shows a pliers-knife described in U.S. patent application Ser. No. 09/229,888 assigned to the present assignee, the entire contents of which are incorporated herein by reference. The pliers-knife 1 described in this reference includes a pair of universal pliers, one of the jaws of which is fixed and the other can be actuated by a pliers handle 14. Other utensils—in this example a large knife blade 13, a can opener 15, and a bottle opener 16—are also disposed in an interior space 12 between the sidepieces of the pliers-knife and can be pulled out by pivoting them about a transverse spindle (not shown), as in ordinary folding penknives. Interior space 12 is at least partially closed at the back of the knife by elastic leaf-springs of known type acting upon utensils 13–16. Further housed in or against sidepieces 10, 11 of pliers-knife 1 are an adapter-extension 19 and tweezers (not shown). The pliers-knife of FIG. 1 further includes an opening at the longitudinal end of the knife for receiving various removable utensils 3 to which the user has access by lifting a magazine lid 2 over interior space 12 between the sidepieces of the tool. The removable utensils are held by matching housings in lid 2. Lid 2 may be detached from the body of knife 1 by disengaging resilient snap means 27 from matching openings 17 in the pliers-knife. Means 27 consist of a plastic or steel hinge, or of spring or clip means allowing lid 2 to be released from and attached to knife 1 without additional tools.

The pliers-knife described in this reference includes a hook 140 fixed to the rear of the knife body, whereby handle 14 of the pliers can be locked in closed position. In this position, magazine lid 2 cannot be raised. Hook 140 therefore makes it possible simultaneously to lock magazine lid 2.

Hook 140 constitutes a relatively fragile element which could be deformed or even ripped off the knife without the use of much force. Moreover, it should preferably be manipulated between the thumb and index finger, which are generally holding the pliers near the other end at the front of the tool; it is therefore necessary to take hold of the pliers-knife again in order to release or lock hook 140, so that one-handed manipulation is very difficult. Furthermore, this hook remains pivoting as an extension of the knife when handle 14 is unhooked, hampering the manipulation of the pliers and other utensils in the tool. Finally, it is necessarily wider than magazine 2, so that it occupies space which could be used by other blades or utensils and further hampers the extraction of these utensils.

It is an object of this invention to provide a multifunctional pocket tool comprising an improved pair of pliers as compared with prior art tools.

Another object of the invention is to provide a multifunctional pocket tool wherein the problem of locking the pliers in closed position is solved while the drawbacks of prior art devices are avoided.

To this end, in the pocket tool according to the present invention, of the type initially mentioned, the means for locking the pliers include at least one locking element disposed at the front end of the tool and capable of being moved in a plane parallel to the sidepieces between a position where the pliers are locked in closed position and a position permitting the pliers to be opened.

A preferred embodiment of the invention will now be described in detail with reference to the accompanying drawings, in which.

Although the embodiment to be described relates especially to a pliers-knife provided with a magazine for removable adapters, it should be well understood that the invention may apply equally well to other types of multifunctional tools which can receive any kind of removable utensil, e.g., to multifunctional knives of the pliers-knife type, to knives provided with a monkey-wrench extension, or to polyvalent knives equipped especially with a pair of shears.

Figure 2:
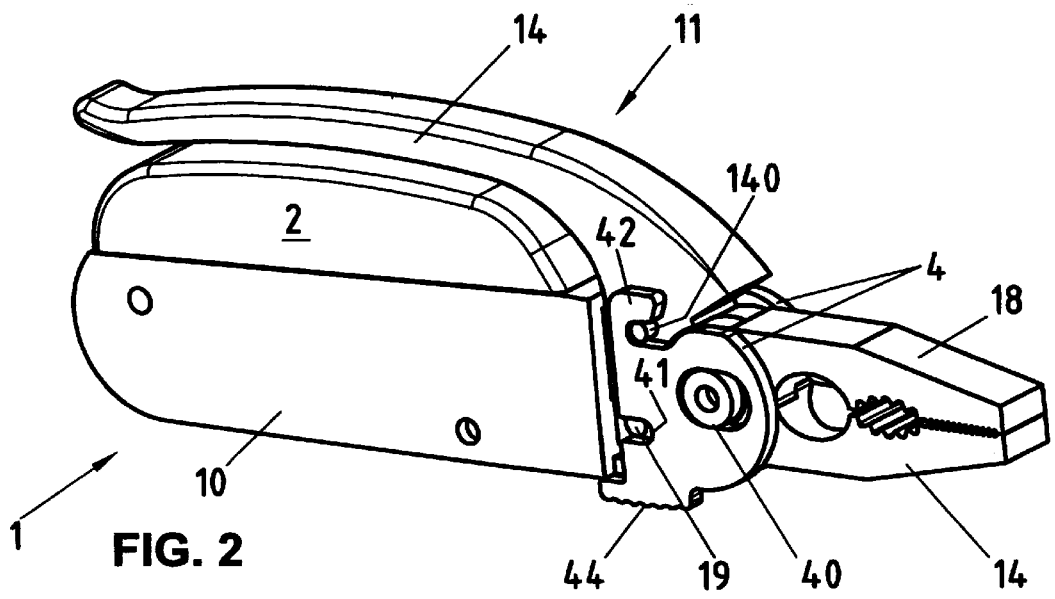
FIG. 2 is a perspective view of a pliers-knife according to the present invention.

In the embodiment illustrated in FIG. 2, a pliers-knife 1 includes a pair of universal pliers, one of the jaws 18 of which is fixed, while the other can be actuated by a pliers handle 14. Other utensils (not shown), e.g., a large knife blade, a can opener, a bottle opener, etc., may also be disposed in an interior space between the sidepieces of the pliers-knife and can be pulled out of it by pivoting them about a transverse spindle (not shown), as in ordinary folding penknives. The interior space is preferably at least partially closed at the back of the knife by elastic leaf-springs of known type, acting upon these utensils.

Sidepieces 10, 11 of knife 1 are preferably of metal, possibly covered with molded or injected synthetic material. However, they may be made of any other material instead, e.g., of horn, wood, etc., depending upon the esthetic aspect it is desired to give to the knife. Generally speaking, the two sidepieces 10, 11 comprise parallel inside faces defining an interior space in which various utensils are disposed parallel to one another, and outside faces ergonomically adapted to the user's hand, e.g., symmetrical.

Figure 1:
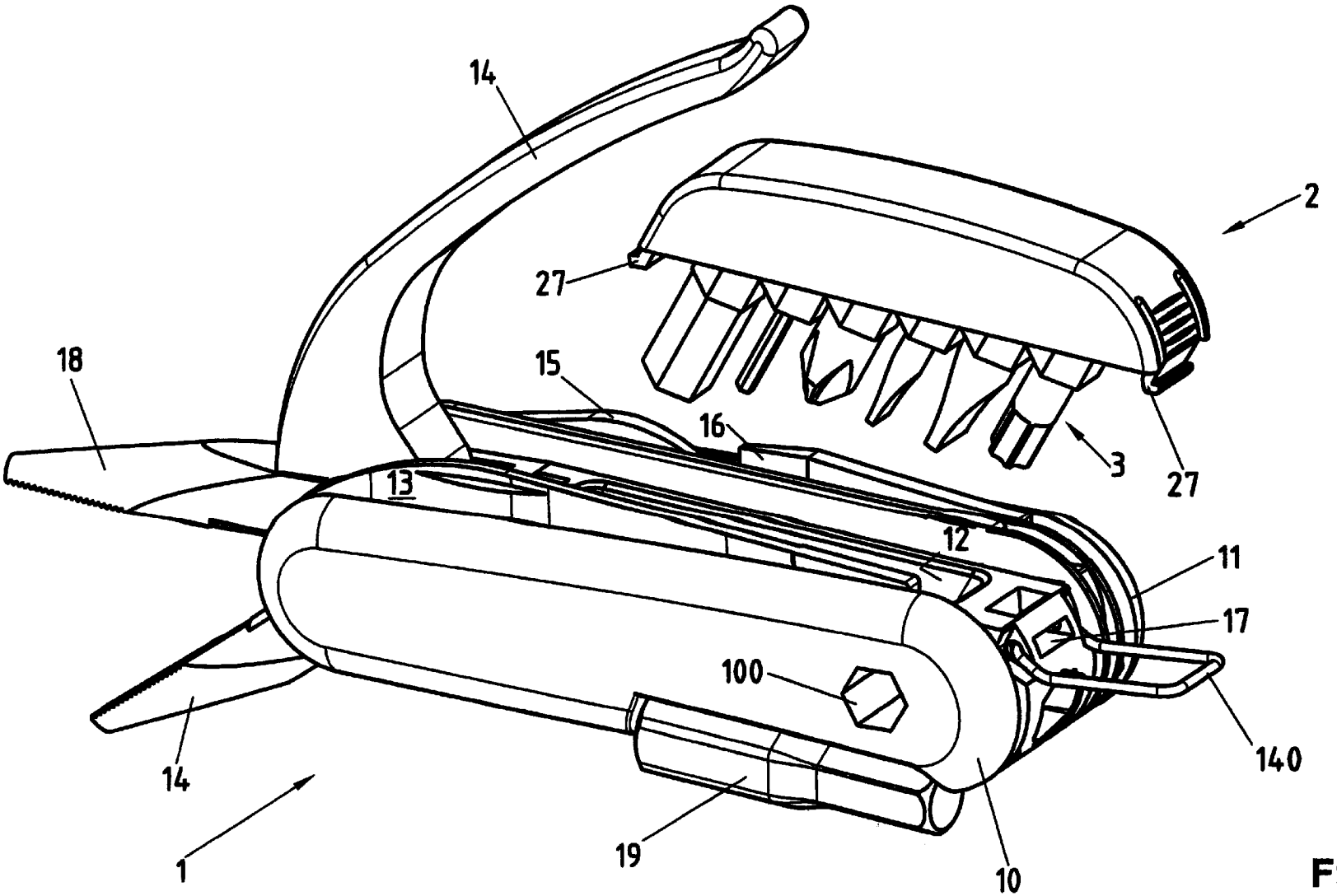
FIG. 1 is a perspective view of the pliers-knife described in the aforementioned U.S. patent application Ser. No. 09/229,888.

The inventive tool preferably includes a tool magazine provide with a lid 2 for housing several utensils, such as adapters or small tools, for instance. The utensils may, for example, be fixed in recesses provided in lid 2 and/or in the bottom or the faces of the interior space, or possibly be disposed loose in this space. Cover 2 can be detached from the body of knife 1 by disengaging resilient snap means from matching openings in the pliers-knife. The snap means consist, for example, of a plastic or steel hinge, as shown in FIG. 1; other designs, e.g., spring or clip means, may easily be conceived by those skilled in the art for releasing and attaching lid 2 to knife 1 without additional tools. In one modification (not shown), lid 2 is not completely removable but remains integral with knife 1, e.g., by means of a hinge on one of the longitudinal ends of the lid. In this modification, only the other end of the magazine lid can be raised to gain access to the utensils. This modification has the advantage of reducing the risk of loss of the lid, though making it less easy to disengage the utensils.

Figure 3:
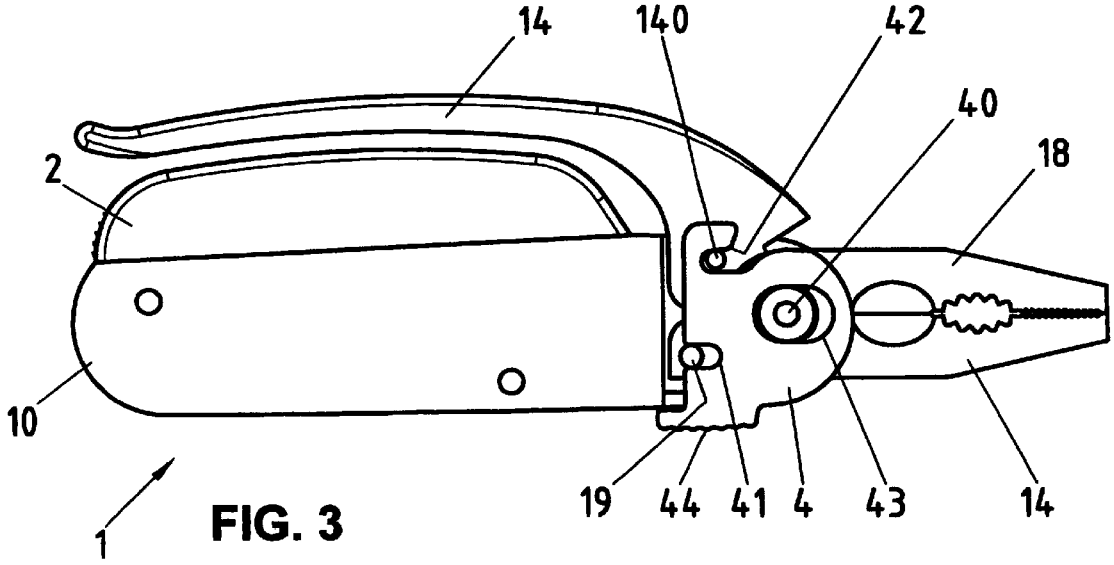
FIG. 3 is an elevation of the inventive tool with the pliers locked in closed position.

The inventive pliers-knife comprises a pliers-locking element 4 made up, in this embodiment, of two integral plates on the two faces of the knife. In the position shown in FIGS. 2 and 3, these snap means are pushed all the way toward the end of the knife, in locking position; in this position, opening of the pliers is blocked by the insertion of a stud projecting from each side of handle 14 into a slideway 42 in each plate of locking element 4, thus preventing pivoting of the handle about a spindle 40. Thus, the pliers cannot be opened when element 4 is in that position. When folded down, handle 14 itself prevents opening of lid 2 of the tool magazine. However, a modification might be easily conceived where, if need be, the user could gain access to the tools in the magazine even when the handle of the pliers is locked.

Figure 4:
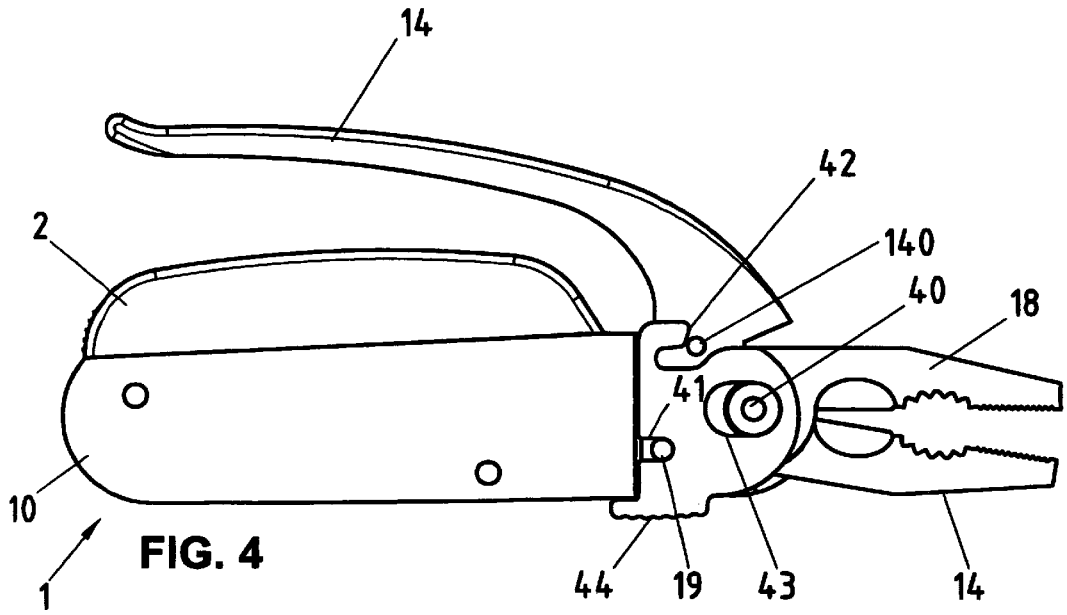
FIG. 4 is an elevation of the same tool with the pliers unlocked in an intermediate position.

To release the pliers, the user moves locking element 4 by pulling it, e.g., with his thumb acting upon a zone 44, toward the rear of the knife, into the position shown in FIG. 4. Zone 44 is preferably grooved or at least given a non-slip surface. Movement of locking element 4 is guided on each face of the knife by a projection 19 of the knife fitted into a slideway 41 of element 4, as well as by pivot-spindle 40 of the pliers, fitted in turn into a slideway 43. These elements allow simultaneous movement of the two plates of locking element 4, each in its own plane and in the longitudinal direction of the knife. It will be noted in this connection that locking element 4 may easily be manipulated with the thumb of the hand holding pliers-knife 1, so that manipulation with just one hand is readily possible. By retracting locking element 4 in this way, a projection 140 can be disengaged from the corresponding slideway 42 on each face, thus releasing jaw 14 for pivoting.

A coil spring (not shown) is preferably so placed as to push against handle 14 and thus cause partial opening of the pliers as soon as locking is released, in an intermediate position already allowing small-diameter objects to be grasped or cut while still keeping pliers-knife 1 and handle 14 in one hand. In a modification, partial opening of the pliers may be actuated by the leaf-springs of pliers-knife 1 already mentioned earlier (though not shown).

Figure 5:
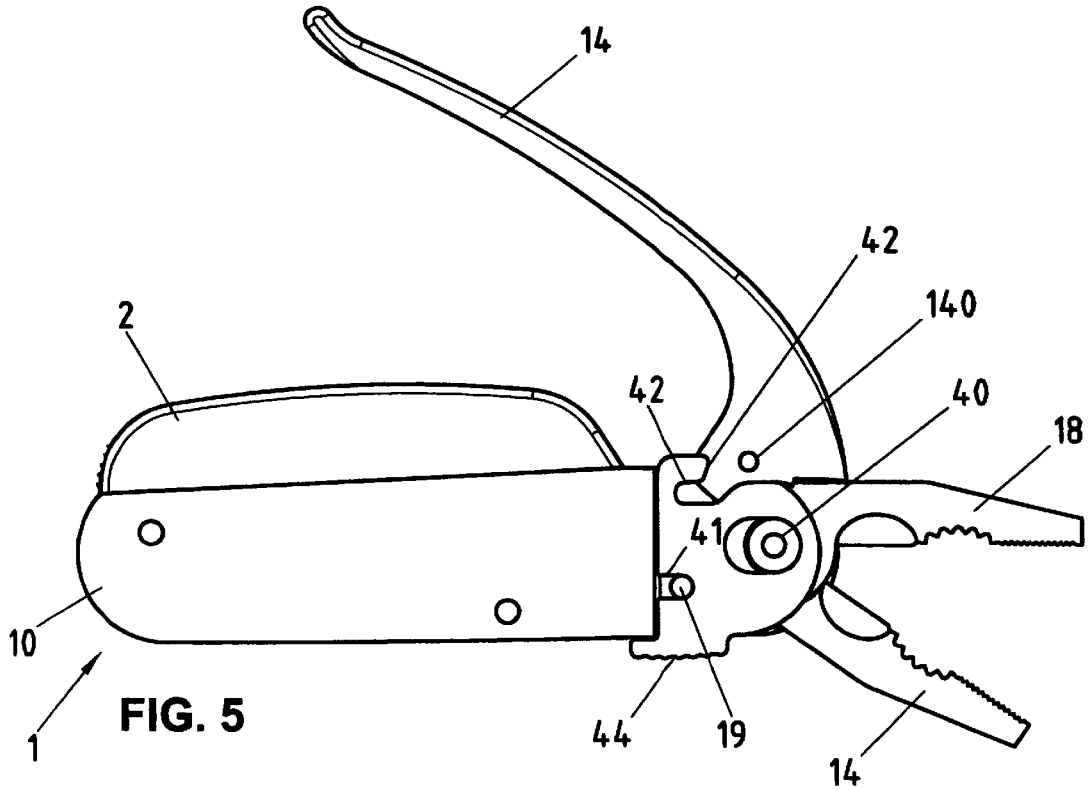
FIG. 5 is an elevation of the same tool with the pliers unlocked in a completely opened position.

To obtain more complete opening of the pliers, as shown in FIG. 5, handle 14 must be moved away from the knife body manually, the friction of the two jaws against one another allowing this more open position to be maintained. To close the pliers again, handle 14 is pressed down against the knife body by acting against the bias of the coil spring or leaf-springs in order to close the jaws completely.

Those skilled in the art will understand that it is likewise possible to use a pliers-locking element different from the element 4 shown while remaining within the scope of the present invention. For instance, it would be possible to use a locking element comprising a single plate on only one side of the tool. Moreover, it would be possible to use a locking element which would be moved by a rotary motion, e.g., about spindle 40, rather than by a translatory motion, simply by adapting the shapes of slideways 41, 42, and 43. The number and shapes of the guiding slideways and the corresponding projections 19, 40, 140 may furthermore be rather freely modified, optimum guidance being ensured, however, by at least two slideways on each face of element 4. It would further be equally possible to invert the positions of the projections and slideways on the body of the tool and on locking element 4.

It will be understood by those skilled in the art that the additional features described especially in the prior art initially referred to may be added to or combined with the features of the tool described here. In particular, it is possible to provide in the lateral faces of the inventive tool an opening for adapters such as suggested in the earlier mentioned U.S. Pat. No. 5,809,600 or to design the magazine according to the teaching of U.S. Pat. No. 5,809,600. The reader is therefore expressly requested to consult these two reference in order to combine their features with those of the present invention. Moreover, neither will those skilled in the art have any difficulty in adapting other characteristics or utensils of prior art pocket knives to the inventive knife.

What is claimed is:

1. A multifunctional pocket tool comprising:

two lateral sidepieces serving as a handle for the tool;

a plurality of tools dispersed between said sidepieces;

a transverse spindle disposed at one end of the tool; and a pair of pliers comprising:

a first jaw fixed integrally to said lateral sidepieces;

a second jaw capable of pivoting relative to said first jaw about said transverse spindle; and at least one locking element, disposed at the same end of the tool as said transverse spindle, capable of being moved in a plane parallel to said sidepieces between a position wherein said pliers are locked in a closed position and an open position permitting said pliers to be opened wherein said locking element comprises:

at least one plate capable of sliding in its own plane parallel to said sidepieces; and a grasping portion whereby said locking element can be manipulated, wherein said grasping portion is situated on the face of said tool opposite to the face including said handle of said pliers, and said locking element can be manipulated with the user's thumb.

2. A pocket tool according to claim 1, wherein said locking element comprises two plates joined to one another and disposed one on each side of said tool outside said sidepieces.

3. A pocket tool according to claim 2, further comprising at least one guide element integral with said sidepieces for guiding the sliding of said at least one plate.

4. A pocket tool according to claim 3, further comprising a said guide element disposed on each face of said locking element for guiding the sliding of said plate.

5. A pocket tool according to claim 2, further comprising at least one guide element integral with said transverse spindle for guiding the sliding of said plate.

6. A pocket tool according to claim 1 wherein said handle includes at least one portion capable of being engaged in or disengaged from said locking element for locking said pliers in said closed position.

7. A pocket tool according to claim 1 further comprising a tool magazine holding at least some of said plurality of tools, a lid covering said tool magazine, and means for preventing said lid from being opened when said locking element is in said locking position.

8. A pocket tool according to claim 1 further comprising at least one guide element integral with said side pieces for guiding the sliding said at least one plate.

9. A multifunctional pocket tool comprising:

two lateral side pieces serving as a handle for the tool;

a plurality of tools dispersed between the side pieces;

a transverse spindle disposed at one end of the tool; and a pair of pliers comprising:

a first jaw fixed integrally to the lateral side pieces;

a second jaw capable of pivoting relative to the first jaw about the transverse spindle; and at least one locking element, disposed at the same end of the tool as the transverse spindle, capable of being moved in a plane parallel to the side pieces between a closed position wherein the pliers are locked and an open position wherein the pliers can be opened, wherein said locking element comprises:

two plates joined to one another and disposed one on each side of said tool outside said sidepieces.

10. A pocket tool according to claim 9, further comprising at least one guide element integral with said sidepieces for guiding the sliding of said at least one plate.

11. A pocket tool according to claim 10, further comprising a said guide element disposed on each face of said locking element for guiding the sliding of said plate.

12. A pocket tool according to claim 9, further comprising at least one guide element integral with said transverse spindle for guiding the sliding of said plate.

* * * * *